US011390097B2

(12) United States Patent
Ukawa

(10) Patent No.: US 11,390,097 B2
(45) Date of Patent: Jul. 19, 2022

(54) RECORDING-MEDIUM TRANSPORT DEVICE AND IMAGE FORMING APPARATUS

(71) Applicant: FUJIFILM Business Innovation Corp., Tokyo (JP)

(72) Inventor: Takayuki Ukawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 165 days.

(21) Appl. No.: 16/867,517

(22) Filed: May 5, 2020

(65) Prior Publication Data

US 2021/0107297 A1 Apr. 15, 2021

(30) Foreign Application Priority Data

Oct. 9, 2019 (JP) ..... JP2019-186325

(51) Int. Cl.
*B41J 11/00* (2006.01)

(52) U.S. Cl.
CPC ..... *B41J 11/007* (2013.01)

(58) Field of Classification Search
CPC ... B41J 15/04; B41J 11/42; B41J 15/16; B41J 15/165; B41J 11/007; B41J 29/393
See application file for complete search history.

(56) References Cited

FOREIGN PATENT DOCUMENTS

| | | |
|---|---|---|
| JP | 2007052112 | 3/2007 |
| JP | 2011-090092 | 5/2011 |

*Primary Examiner* — Jannelle M Lebron
(74) *Attorney, Agent, or Firm* — JCIPRNET

(57) ABSTRACT

A recording-medium transport device includes a first pressed portion, a second pressed portion, a mover, and a sensor. The first pressed portion moves by being pressed by a transported recording medium. The second pressed portion is disposed at a different position from the first pressed portion in a width direction of the transported recording medium. The second pressed portion moves by being pressed by the transported recording medium. The mover moves in association with the first pressed portion and the second pressed portion. The mover moves in response to the recording medium being pressed by at least one of the first pressed portion and the second pressed portion. The sensor detects movement of the mover.

13 Claims, 15 Drawing Sheets

FIRST END

SECOND END

FIG. 8

| | SECOND SENSOR | FIRST SENSOR | DETERMINATION |
|---|---|---|---|
| (1) | ON | OFF | SMALL SWELL |
| (2) | OFF | ON | LARGE SWELL |
| (3) | OFF | OFF | UNEVEN SWELL |
| (4) | ON | ON | UNEVEN SWELL OR SHEET PASSED |

8A 8B 8C 8D

RECORDING-MEDIUM TRANSPORT DEVICE AND IMAGE FORMING APPARATUS

CROSS-REFERENCE TO RELATED APPLICATIONS

This application is based on and claims priority under 35 USC 119 from Japanese Patent Application No. 2019-186325 filed Oct. 9, 2019.

BACKGROUND

(i) Technical Field

The present disclosure relates to a recording-medium transport device and an image forming apparatus.

(ii) Related Art

Japanese Unexamined Patent Application Publication No. 2007-52112 discloses a structure that includes multiple loop sensors arranged between a transfer unit and a fixing unit in a recording medium direction, and in which a motor controller controls a fixing motor on the basis of loop detection results of these.

Japanese Unexamined Patent Application Publication No. 2011-90092 discloses processing of avoiding problems by changing the driving speed of a fixing device or changing the orientation of a transport guide when the measurement value of any of the loop sensors exceeds a predetermined value.

SUMMARY

A device to which a recording medium is transported includes a mover that moves in response to an arrival of a recording medium at a predetermined position, and is capable of detecting the arrival of the recording medium at the predetermined position by detecting movement of the mover.

In the structure including multiple movers and sensors corresponding to these movers to detect these movers, the sensors correspond in number to the movers.

Aspects of non-limiting embodiments of the present disclosure relate to reduction of sensors that detect movers that move in response to an arrival of a recording medium at a predetermined position, compared to the case where sensors that detect movers are provided for corresponding movers that move in response to an arrival of a recording medium at a predetermined position.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recording-medium transport device that includes a first pressed portion that moves by being pressed by a transported recording medium; a second pressed portion disposed at a different position from the first pressed portion in a width direction of the transported recording medium, the second pressed portion moving by being pressed by the transported recording medium; a mover that moves in association with the first pressed portion and the second pressed portion, the mover moving in response to the recording medium being pressed by at least one of the first pressed portion and the second pressed portion; and a sensor that detects movement of the mover.

BRIEF DESCRIPTION OF THE DRAWINGS

Exemplary embodiments of the present disclosure will be described in detail based on the following figures, wherein:

FIG. 8 illustrates a determination table;

DETAILED DESCRIPTION

Exemplary embodiments of the present disclosure will be described below with reference to the attached drawings.

Figure 1:
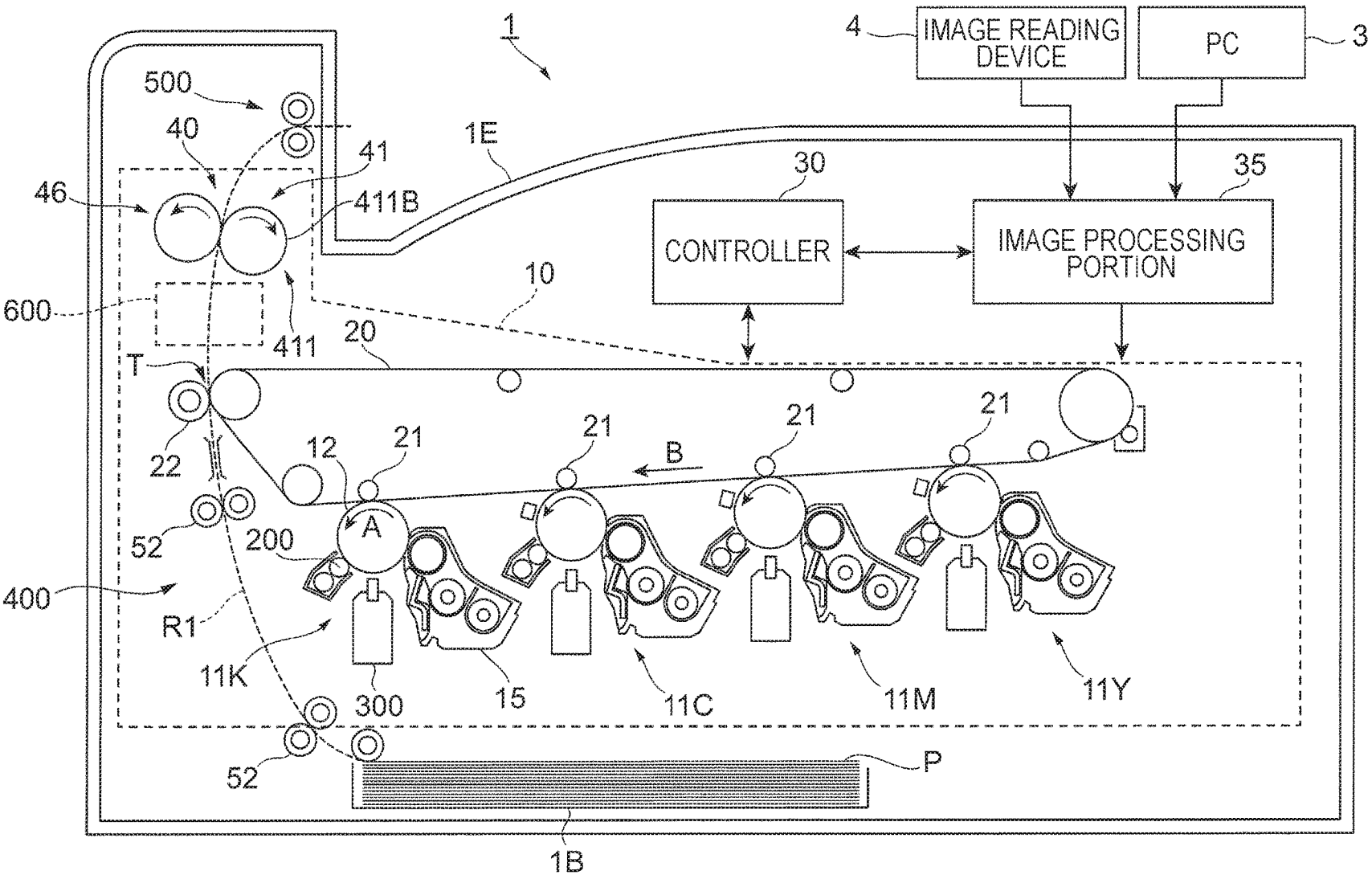
FIG. 1 illustrates an entire structure of an image forming apparatus.

FIG. 1 illustrates an entire structure of an image forming apparatus 1. More specifically, FIG. 1 is a view of the image forming apparatus 1 viewed from the front side of the image forming apparatus 1.

The image forming apparatus 1 includes an image forming portion 10, as an example of an image forming device. The image forming portion 10 performs image formation on a sheet P, which is an example of a recording medium, based on image data for different colors.

The image forming apparatus 1 also includes a sheet transport device 400, which transports sheets P.

The sheet transport device 400, which is an example of a recording-medium transport device, transports sheets P contained in a sheet container 1B to a sheet receiver 1E via a second transfer portion T and a fixing device 40.

Here, the sheet transport device 400 includes transport rollers 52 and discharge rollers 500. The sheet transport device 400 transports the sheets P using the transport rollers 52 and the discharge rollers 500.

The image forming apparatus 1 also includes a controller 30 and an image processing portion 35.

The controller 30 controls functional units of the image forming apparatus 1. The image processing portion 35 performs image processing on image data from, for example, a personal computer (PC) 3 or an image reading device 4.

Figure 2:
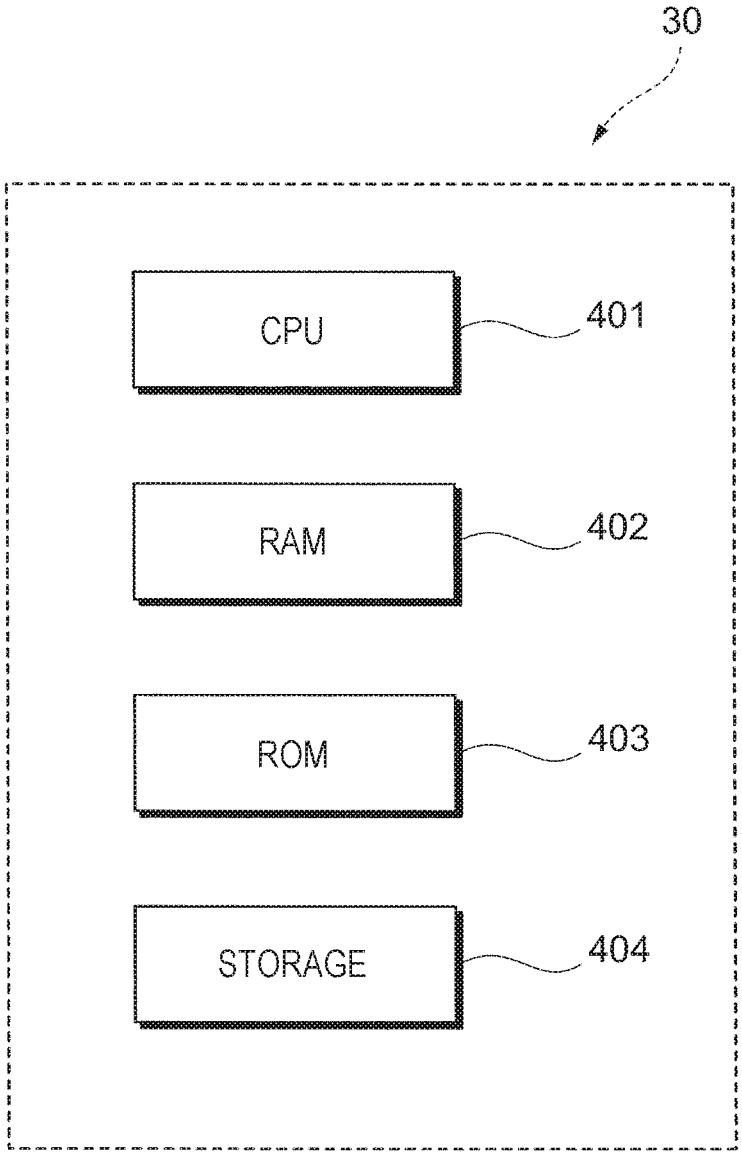
FIG. 2 illustrates a structure of a controller.

As illustrated in FIG. 2 (illustrating the structure of the controller 30), the controller 30 includes a central processing unit (CPU) 401, which is an example of a processor, a random access memory (RAM) 402, a read only memory (ROM) 403, and a storage 404, formed from a hard disk or other devices.

The ROM 403 and the storage 404 store programs to be executed by the CPU 401. The CPU 401 reads programs stored in the ROM 403 or the storage 404, and executes each program using the RAM 402 as a work area.

The CPU 401 implements various functions by executing the programs stored in the ROM 403 or the storage 404.

Here, the programs to be executed by the CPU 401 may be provided to the image forming apparatus 1 in the form of being stored in a computer-readable recording medium such as a magnetic recording medium (such as a magnetic tape or a magnetic disk), an optical recording medium (such as an optical disk), an optical magnetic recording medium, or a semiconductor memory. The programs to be executed by the CPU 401 may also be provided to the image forming apparatus 1 through a communication device such as the Internet.

In the present exemplary embodiment, a processor refers to a broadly interpreted processor, and includes a general-purpose processor (such as a central processing unit (CPU)), and an exclusive-use processor (such as a graphics processing unit (GPU), an application specific integrated circuit (ASIC), a field programmable gate array (FPGA), or a programmable logical device).

The operation may be performed not only by a single processor, but also by multiple processors physically spaced apart from each other in cooperation. The order in which processing is performed by the processor is not limited to the order described in the present exemplary embodiment, but may be changed.

The image forming apparatus 1 will be described further with reference to FIG. 1.

The image forming portion 10 includes four image forming units 11Y, 11M, 11C, and 11K (hereinafter also simply referred to as "image forming units 11", collectively) arranged side by side at regular intervals.

The image forming units 11 have the same structure except for accommodating different types of toner in respective developing devices 15. The image forming units 11 form toner images (images) of yellow (Y), magenta (M), cyan (C), and black (K).

Each image forming unit 11 includes a photoconductor drum 12, a charging device 200, which electrically charges the photoconductor drum 12, and a LED print head (LPH) 300, which exposes the photoconductor drum 12 to light.

The photoconductor drum 12 is electrically charged by the charging device 200. The photoconductor drum 12 is also exposed to light by the LPH 300 to have an electrostatic latent image formed thereon.

Each image forming unit 11 also includes a developing device 15, which develops an electrostatic latent image formed on the photoconductor drum 12, and a cleaner (not illustrated) that cleans the surface of the photoconductor drum 12.

The image forming portion 10 includes an intermediate transfer belt 20, to which toner images of different colors formed by the photoconductor drums 12 are transferred, and first transfer rollers 21, which sequentially transfer (first-transfer) the toner images of different colors formed by the photoconductor drums 12 to the intermediate transfer belt 20.

The image forming portion 10 also includes a second transfer roller 22, which collectively transfers (second-transfers) the toner images transferred onto the intermediate transfer belt 20 to a sheet P, and a fixing device 40, which fixes the toner images transferred to the sheet P onto the sheet P.

The exemplary embodiment also includes a sheet detecting device 600, which detects a sheet P, downstream of the second transfer roller 22 and upstream of the fixing device 40.

The fixing device 40 includes a fixing belt module 41 including a heating member, and a pressing roller 46.

The fixing belt module 41 is disposed on the right of a sheet transport path R1 in the drawing. The pressing roller 46 is disposed on the left of the sheet transport path R1 in the drawing. The pressing roller 46 is pressed against the fixing belt module 41.

The fixing belt module 41 includes a film-shaped fixing belt 411, which comes into contact with the sheet P. The fixing belt 411 is a device for fixing a toner image (image) on the sheet P onto the sheet P.

The fixing belt 411 includes, for example, a release layer disposed outermost to come into contact with the sheet P, an elastic layer disposed adjacent to and on the inner side of the release layer, and a base layer that supports the elastic layer.

The fixing belt 411 is annular and rotates clockwise in the drawing. In other words, the fixing belt 411 is endless and circularly moves along a predetermined path.

The fixing belt 411 comes into contact with the sheet P transported from below in the drawing. More specifically, the fixing belt 411 has an outer peripheral surface 411B, which comes into contact with the sheet P.

The portion of the fixing belt 411 that is in contact with the sheet P moves together with the sheet P. The fixing belt 411 holds the sheet P together with the pressing roller 46 to press and heat the sheet P.

The fixing belt module 41 also includes a heating member on the inner side of the fixing belt 411 to heat the fixing belt 411.

The pressing roller 46 serving as an example of a pressing member is disposed on the left side of the sheet transport path R1 in the drawing. The pressing roller 46 is pressed against the outer peripheral surface 411B of the fixing belt 411 to press the sheet P passing between the fixing belt 411 and the pressing roller 46.

The pressing roller 46 is rotated counterclockwise in the drawing by a motor (not illustrated). When the pressing roller 46 rotates counterclockwise, the fixing belt 411 rotates clockwise with the driving force received from the pressing roller 46.

In the exemplary embodiment, the fixing device 40 also has a function of transporting downstream a sheet P transported thereto from upstream. While transporting the sheet P, the fixing device 40 fixes a toner image on the sheet P.

In the exemplary embodiment, the transport speed of the sheet P in the fixing device 40 is changeable. More specifically, in the exemplary embodiment, the transport speed of the sheet P with the fixing device 40 is changeable by changing the number of rotations of the pressing roller 46.

In the image forming apparatus 1, the image processing portion 35 performs image processing on image data from the PC 3 or the image reading device 4, and the image data undergoing image processing is fed to each image forming unit 11.

Then, for example, in the image forming unit 11K for black (K), the photoconductor drum 12 is electrically charged by the charging device 200 while rotating in the direction of arrow A, and exposed to light emitted from the LPH 300 on the basis of the image data transmitted from the image processing portion 35.

Thus, an electrostatic latent image for a black (K) image is formed on the photoconductor drum 12. The electrostatic latent image formed on the photoconductor drum 12 is developed by the developing device 15 into a toner image for black (K) formed on the photoconductor drum 12.

Similarly, the image forming units 11Y, 11M, and 11C respectively form toner images of yellow (Y), magenta (M), and cyan (C).

The toner images of respective colors formed by the respective image forming units 11 are sequentially electrostatically attracted by the first transfer rollers 21 to the intermediate transfer belt 20 moving in the direction of arrow B, so that a superposed toner image including toner of different colors is formed on the intermediate transfer belt 20.

The toner image formed on the intermediate transfer belt 20 is transported to a position (second transfer portion T) where the second transfer roller 22 is located by the movement of the intermediate transfer belt 20.

At the timing when the toner image is transported to the second transfer portion T, a sheet P is fed from the sheet container 1B to the second transfer portion T.

At the second transfer portion T, the toner image on the intermediate transfer belt 20 is collectively and electrostatically transferred to the sheet P transported to the second transfer portion T with a transfer electric field formed by the second transfer roller 22.

Thereafter, the sheet P to which the toner image is electrostatically transferred is separated from the intermediate transfer belt 20, and transported to the fixing device 40.

In the exemplary embodiment, while the sheet P is transported from the intermediate transfer belt 20 to the fixing device 40, the sheet detecting device 600 detects the sheet P.

The fixing device 40 holds the sheet P between the fixing belt module 41 and the pressing roller 46. More specifically, the fixing device 40 holds the sheet P with the fixing belt 411, circularly moving clockwise, and the pressing roller 46, rotating counterclockwise.

Thus, the sheet P undergoes pressing and heating to have a toner image thereon fixed thereto. The sheet P undergoing fixing is transported to the sheet receiver 1E by the discharging rollers 500.

Figure 3:
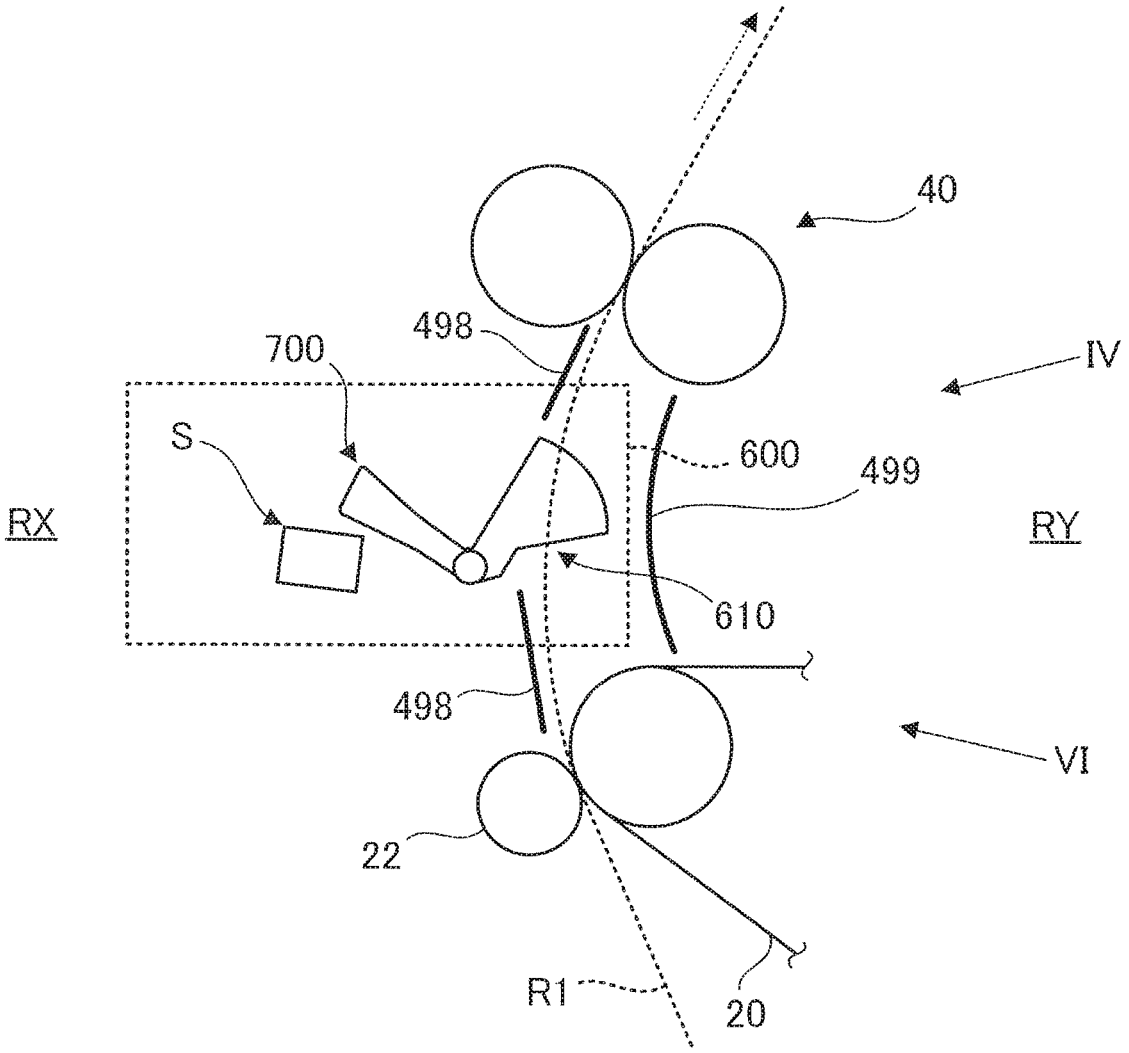
FIG. 3 illustrates a sheet detecting device.

FIG. 3 illustrates the sheet detecting device 600.

The sheet detecting device 600 according to the exemplary embodiment includes a pressed portion 610, which moves by being pressed by a transported sheet P.

The sheet detecting device 600 includes movers 700 that move in association with the pressed portion 610. The movers 700 move in response to the pressed portion 610 being pressed by the sheet P.

The sheet detecting device 600 also includes guide members 498, which guide the transported sheet P downstream. The exemplary embodiment also includes pressed portions 610 on the side closer to the sheet transport path R1 than the guide members 498.

The sheet detecting device 600 according to the present exemplary embodiment also includes a second guide member 499 that guides the transported sheet P downstream at a position opposite to the guide members 498.

In the exemplary embodiment, the guide members 498, the movers 700, and sensors S (described below) are disposed on a first side RX of the sheet transport path R1, and the second guide member 499 is disposed on a second side RY of the sheet transport path R1.

In the exemplary embodiment, the movers 700 are disposed opposite to the pressed portions 610 with respect to the guide members 498.

The exemplary embodiment includes sensors S, which are an example of sensors that detect movement of the mover 700.

Here, as described with reference to FIG. 4, the exemplary embodiment includes multiple pressed portions 610, multiple movers 700, and multiple sensors S.

Figure 4:
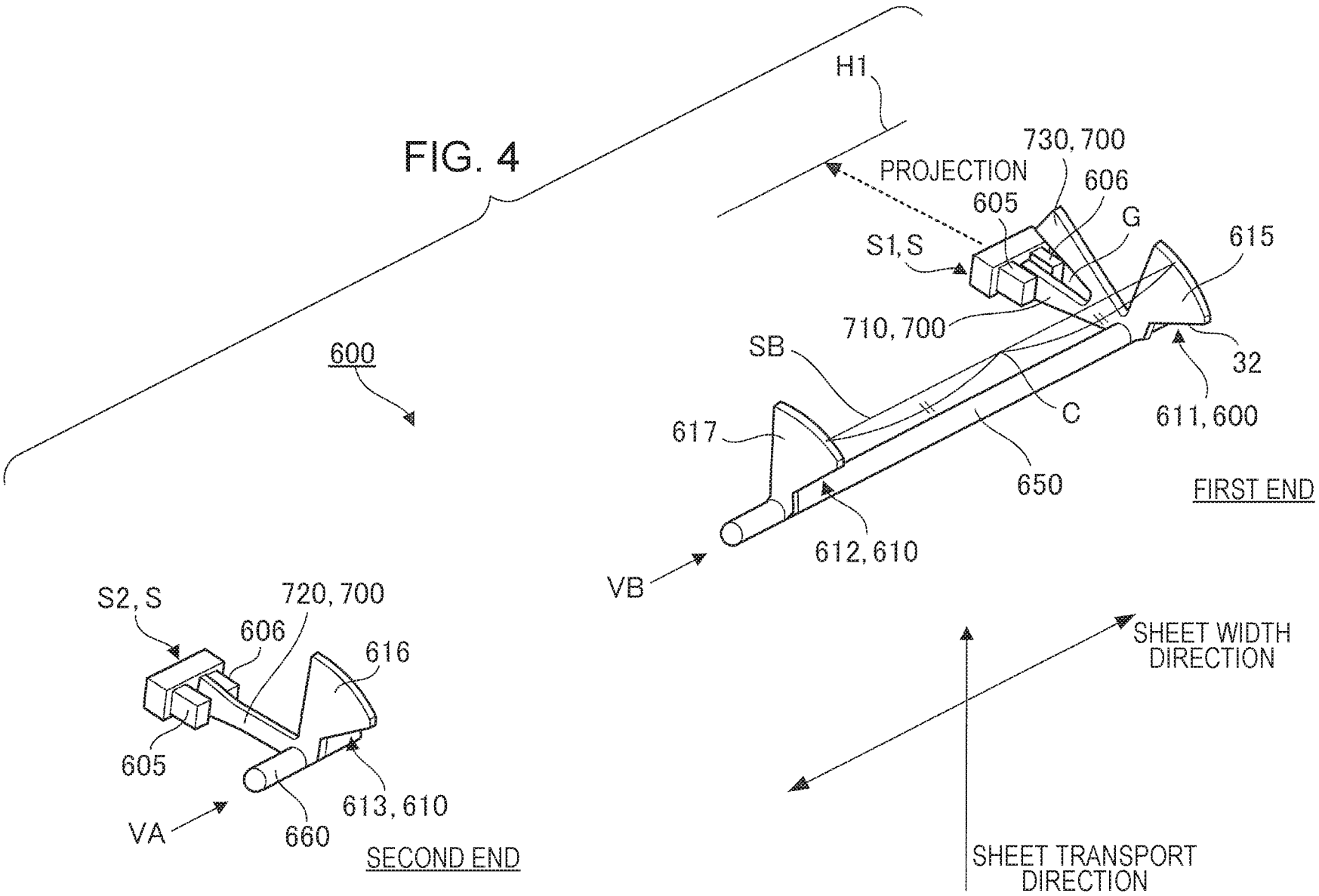
FIG. 4 is a perspective view of a sheet detecting device viewed in a direction of arrow IV in FIG. 3.

FIG. 4 is a perspective view of the sheet detecting device 600 viewed in a direction of arrow IV in FIG. 3.

The exemplary embodiment includes three pressed portions 610 including a first pressed portion 611 to a third pressed portion 613.

Here, the first pressed portion 611 to the third pressed portion 613 are arranged at different positions in the width direction of the transported sheet P.

The exemplary embodiment includes three movers 700, which are movers of a first mover 710 to a third mover 730.

The first mover 710 (an example of a first mover) and the third mover 730 (an example of a third mover) move in association with the first pressed portion 611 (an example of a first pressed portion) and the second pressed portion 612 (an example of a second pressed portion). The first mover 710 and the third mover 730 move when at least one of the first pressed portion 611 and the second pressed portion 612 is pressed by the sheet P.

The second mover 720 (an example of a second mover) moves in association with the third pressed portion 613 (an example of a third pressed portion). The second mover 720 moves when the third pressed portion 613 is pressed by the sheet P.

The exemplary embodiment includes a connector 650, which connects the first pressed portion 611 and the second pressed portion 612. The connector 650 is formed into a round rod-like member, and extends in the width direction of the transported sheet P.

In the exemplary embodiment, the first pressed portion 611, the second pressed portion 612, the first mover 710, and the third mover 730 are fixed to the connector 650. A gap G is disposed between the first mover 710 and the third mover 730.

The first mover 710 and the third mover 730 are disposed on the left side of the connector 650 in the drawing. The first pressed portion 611 is disposed on the right side of the connector 650 in the drawing.

The connector 650 is rotatably supported by a body (not illustrated) of the sheet detecting device 600. More specifically, the round bar-shaped connector 650 is supported at both ends in the longitudinal direction, and rotatable in the circumferential direction.

The exemplary embodiment includes an urging member (not illustrated) that urges the connector 650 clockwise in the drawing. The urging member protrudes the first pressed portion 611 and the second pressed portion 612 toward the sheet transport path R1 (refer to FIG. 3).

A rodlike member 660, extending in the width direction of the sheet P, is disposed near the third pressed portion 613. In the exemplary embodiment, the rodlike member 660 supports the third pressed portion 613 and the second mover 720.

The second mover 720 is disposed on the left of the rodlike member 660 in the drawing. The third pressed portion 613 is disposed on the right of the rodlike member 660 in the drawing.

As in the connector 650, the rodlike member 660 is rotatable.

The exemplary embodiment includes an urging member (not illustrated) that urges the rodlike member 660 clockwise in the drawing. The third pressed portion 613 protrudes toward the sheet transport path R1 (refer to FIG. 3).

The sensors S of the exemplary embodiment include a first sensor S1, which is an example of a first sensor that detects movement of the first mover 710 and the third mover 730.

The sensors S of the exemplary embodiment also include a second sensor S2, which is an example of a second sensor that detects movement of the second mover 720.

The first sensor S1 and the second sensor S2 are so-called transmissive sensors, and each include a light source 605, which emits light, and a light receiving portion 606, which receives light from the light source 605.

In the exemplary embodiment, each of the first mover 710, the second mover 720, and the third mover 730 passes between the corresponding light source 605 and the corresponding light receiving portion 606. Thus, the first sensor S1 detects the first mover 710 and the third mover 730, and the second sensor S2 detects the second mover 720.

Here, in the exemplary embodiment, when each of the first mover 710 and the third mover 730 is located between the light source 605 and the light receiving portion 606 of the first sensor S1, light emitted from the light source 605 is blocked and the first sensor S1 is turned off.

When neither the first mover 710 nor the third mover 730 is located between the light source 605 and the light receiving portion 606 of the first sensor S1, light emitted from the light source 605 arrives at the light receiving portion 606, and the first sensor S1 is turned on.

In the exemplary embodiment, when the second mover 720 is located between the light source 605 and the light receiving portion 606 of the second sensor S2, light emitted from the light source 605 is blocked, and the second sensor S2 is turned off.

When the second mover 720 is not located between the light source 605 and the light receiving portion 606 of the second sensor S2, light emitted from the light source 605 arrives at the light receiving portion 606, and the second sensor S2 is turned on.

Figure 5B:
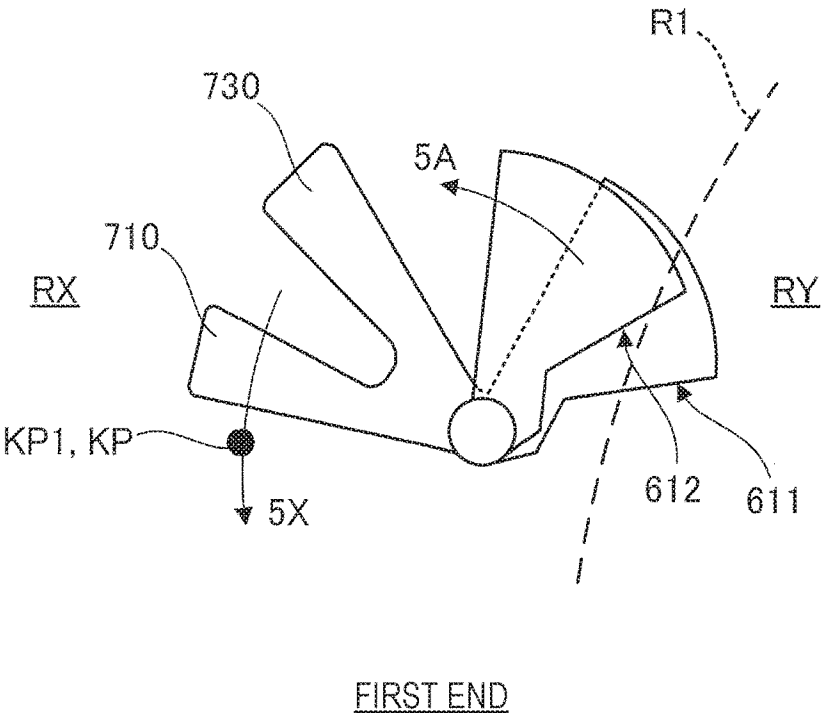
FIGS. 5A and 5B illustrate a first pressed portion to a third pressed portion, a first mover to a third mover, a first sensor, and a second sensor.
Figure 5A:
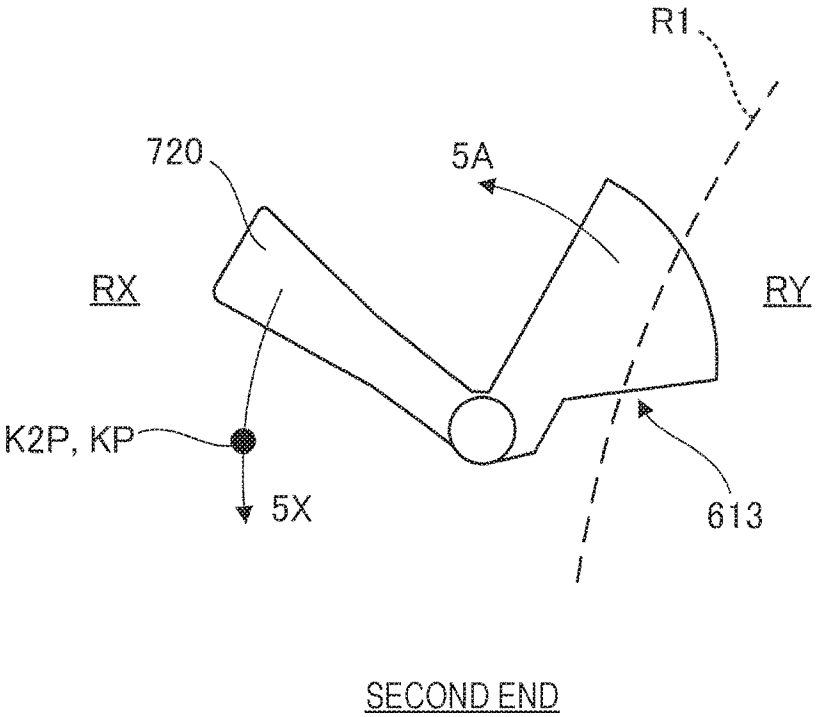

FIGS. 5A and 5B illustrate the first pressed portion 611 to the third pressed portion 613, the first mover 710 to the third mover 730, the first sensor S1, and the second sensor S2.

FIG. 5A illustrates the second sensor S2, the second mover 720, and the third pressed portion 613, viewed in the direction of arrow VA in FIG. 4.

FIG. 5B illustrates the first sensor S1, the first mover 710, the third mover 730, the first pressed portion 611, and the second pressed portion 612, viewed in the direction of arrow VB in FIG. 4.

In the exemplary embodiment, when pressed by the transported sheet P, the first pressed portion 611, the second pressed portion 612, and the third pressed portion 613 move toward the first side RX of the sheet transport path R1, as illustrated in arrow 5A in FIGS. 5A and 5B.

In the exemplary embodiment, when pressed by the transported sheet P, each of the first pressed portion 611 to the third pressed portion 613 moves in a first direction of arrow 5A.

Herein, the above first direction (direction of arrow 5A), in which each of the first pressed portion 611 to the third pressed portion 613 moves, is referred to as a pressed-portion movement direction 5A.

In the exemplary embodiment, when the first pressed portion 611, the second pressed portion 612, and the third pressed portion 613 move downstream in the pressed-portion movement direction 5A, each of the first mover 710 to the third mover 730 moves in the first direction of arrow 5X, as illustrated in FIGS. 5A and 5B.

Herein, the first direction of arrow 5X is referred to as a mover movement direction 5X, below.

In the exemplary embodiment, when the first pressed portion 611 (refer to FIG. 5B) and the second pressed portion 612 move downstream in the pressed-portion movement direction 5A, the first mover 710 and the third mover 730 move downstream in the mover movement direction 5X, and the first mover 710 and the third mover 730 are detected by the first sensor S1.

More specifically, when the first mover 710 and the third mover 730 arrive at a detection position KP (position where light from the light source 605 passes), which is the target of detection of the first sensor S1, the first mover 710 and the third mover 730 are detected by the first sensor S1.

More specifically, as described above, the first sensor S1 according to the exemplary embodiment is a transmissive sensor. In the exemplary embodiment, when arriving at the position at which a light beam for detection passes, the first mover 710 and the third mover 730 are detected by the first sensor S1.

In the exemplary embodiment, when the third pressed portion 613 (refer to FIG. 5A) is pressed by the transported sheet P, the third pressed portion 613 moves downstream in the pressed-portion movement direction 5A.

Thus, the second mover 720 moves downstream in the mover movement direction 5X. The second mover 720 is thus detected by the second sensor S2.

More specifically, when the second mover 720 arrives at the detection position KP for the second sensor S2, the second mover 720 is detected by the second sensor S2.

More specifically, as in the first sensor S1, the second sensor S2 is a transmissive sensor. In the exemplary embodiment, when arriving at the position at which a light beam for detection passes, the second mover 720 is detected by the second sensor S2.

In the exemplary embodiment, the detection position KP at which the first sensor S1 detects a mover is referred to as a first detection position KP1, and the detection position at which the second sensor S2 detects a mover is referred to as a second detection position KP2, below.

In the exemplary embodiment, as illustrated in FIG. 5B, the second pressed portion 612 is located further downstream in the pressed-portion movement direction 5A than the first pressed portion 611.

More specifically, in the exemplary embodiment, the second pressed portion 612 is located further apart from the second guide members 499 (refer to FIG. 3) than the first pressed portion 611.

More specifically, the first pressed portion 611 and the second pressed portion 612 rotate (move) counterclockwise about the connector 650 (refer to FIG. 4). In the exemplary embodiment, the second pressed portion 612 is located further downstream than the first pressed portion 611 in this rotation direction.

In the exemplary embodiment, the second pressed portion 612 is located closer to the first side RX than the first pressed portion 611.

In the exemplary embodiment, when the positions of the first mover 710 to the third mover 730 in the mover movement direction 5X are compared to each other while the sheet P is not in contact with the first pressed portion 611 to the third pressed portion 613, the first mover 710 is located further downstream than the second mover 720, as illustrated in FIGS. 5A and 5B. The third mover 730 is located further upstream than the second mover 720.

More specifically, in the exemplary embodiment, while the sheet P is not in contact with the first pressed portion 611 to the third pressed portion 613, the second mover 720 is located between the first mover 710 and the third mover 730 in the mover movement direction 5X.

Figure 6:
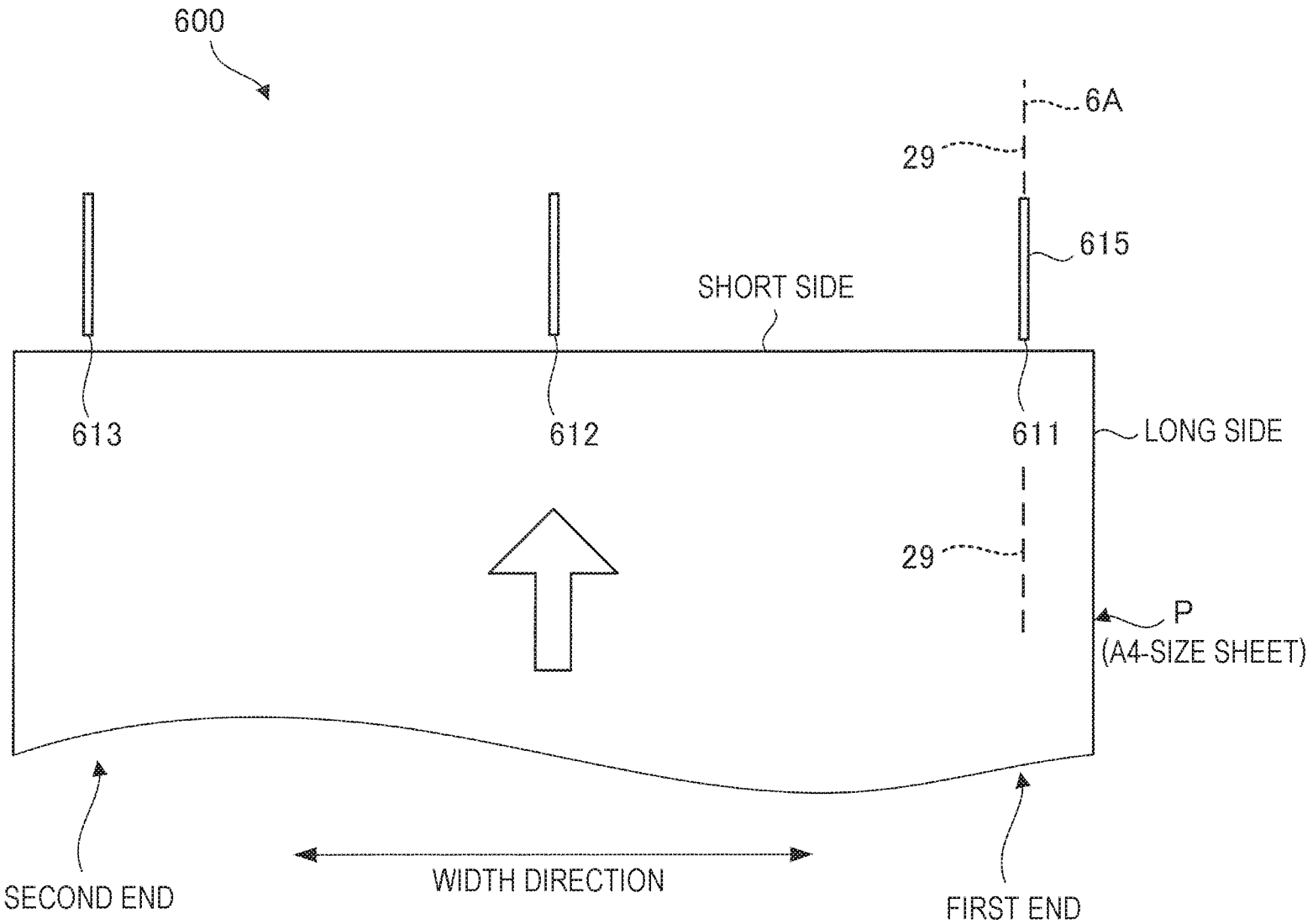
FIG. 6 illustrates a sheet detecting device viewed in a direction of arrow VI in FIG. 3.

FIG. 6 illustrates the sheet detecting device 600 viewed in a direction of arrow VI in FIG. 3. More specifically, FIG. 6 illustrates the sheet detecting device 600 when viewed in a direction perpendicular to the transport direction of the sheet P.

Here, in the exemplary embodiment, when a A4-size sheet P is transported while having its short side at the leading end, the first pressed portion 611 opposes a first end of the A4-size sheet P in the width direction.

The second pressed portion 612 opposes a center portion of the A4-size sheet P in the width direction. The third pressed portion 613 opposes a second end of the A4-size sheet P in the width direction.

Here, "the width direction" refers to the direction perpendicular to the transport direction of the sheet P. More specifically, "the width direction" refers to the direction in which the side at the leading end of the transported sheet P extends.

In the exemplary embodiment, when a A4-size sheet P, which is an example of a sheet P of a predetermined size, is transported in the predetermined position, the first pressed portion 611 opposes the first end of the sheet P in the width direction.

More specifically, in the exemplary embodiment, when the A4-size sheet P, which is an example of a predetermined-sized sheet P, is transported while having its short side at the leading end, the first pressed portion 611 opposes the first end of the sheet P in the width direction.

The second pressed portion 612 opposes the center portion of the sheet P in the width direction. The third pressed portion 613 opposes the second end of the sheet P in the width direction.

More specifically, in the exemplary embodiment, the sheet P is transported with reference to the center. In the exemplary embodiment, the center portion of the sheet P in the width direction passes a position opposite to the second pressed portion 612.

The first end of the sheet P in the width direction passes the position opposite to the first pressed portion 611. The second end of the sheet P in the width direction passes the position opposite to the third pressed portion 613.

In the exemplary embodiment, as illustrated in FIG. 5B, the second pressed portion 612 is located further downstream in the pressed-portion movement direction 5A than the first pressed portion 611.

In the exemplary embodiment, the first pressed portion 611 and the third pressed portion 613 are aligned in the pressed-portion movement direction 5A.

In the exemplary embodiment, as illustrated in FIG. 4, the first mover 710 and the third mover 730 are arranged closer to either one of the first pressed portion 611 and the second pressed portion 612.

Specifically, in the exemplary embodiment, the first mover 710 and the third mover 730 are arranged closer to the first pressed portion 611.

More specifically, in the exemplary embodiment, the first mover 710 and the third mover 730 are arranged on the side closer to the first pressed portion 611 than a middle point C of a line segment SB extending in the width direction of the sheet P, the line segment SB connecting the first pressed portion 611 and the second pressed portion 612.

In the exemplary embodiment, as illustrated in FIG. 4, the first mover 710 and the third mover 730 are located on an extension line of a plate-shaped member 615.

More specifically, in the exemplary embodiment, a line denoted with a reference sign 6A in FIG. 6 indicates an extension line 29 of the plate-shaped member 615. In the exemplary embodiment, the first mover 710 and the third mover 730 are disposed on the extension line 29.

Here, in the exemplary embodiment, as illustrated in FIG. 4, the plate-shaped member 615 is disposed at a portion where the first pressed portion 611 is disposed.

In the exemplary embodiment, the first mover 710 and the third mover 730 are disposed on the extension line 29 (refer to FIG. 6) of the plate-shaped member 615.

In the exemplary embodiment, an edge 32 (edge 32 located closer to the sheet transport path R1) located on a side of the plate-shaped member 615 (refer to FIG. 4) on which the sheet P passes functions as the first pressed portion 611. More specifically, in the exemplary embodiment, part of the plate-shaped member 615 functions as the first pressed portion 611.

In the exemplary embodiment, the first mover 710 and the third mover 730, which also have a plate shape, are disposed on the extension line 29 (refer to FIG. 6) of the plate-shaped member 615.

More specifically, in the exemplary embodiment, the plate-shaped member 615, the first mover 710, and the third mover 730 are disposed in the thickness direction of the transported sheet P. In the exemplary embodiment, the first pressed portion 611 is formed from part of the plate-shaped member 615 extending in the thickness direction of the sheet P.

In the exemplary embodiment, the first mover 710 and the third mover 730 are disposed on the extension line 29 of the plate-shaped member 615.

More specifically, the first mover 710, the third mover 730, and the plate-shaped member 615 are disposed on the same (common) plane extending in the direction perpendicular to the width direction of the sheet P.

More specifically, in the exemplary embodiment, in comparison with the positions in the width direction of the sheet P, the first mover 710 and the third mover 730 are aligned with the plate-shaped member 615.

More specifically, in the exemplary embodiment, when the first mover 710, the third mover 730, and the plate-shaped member 615 are projected in a direction perpendicular to the width direction of the sheet P and toward a virtual plane H1 (refer to FIG. 4) extending in the width direction of the sheet P, the first mover 710, the third mover 730, and the plate-shaped member 615 are disposed so that they overlap each other.

The same holds true to the third pressed portion 613. In the exemplary embodiment, a plate-shaped member 616 (refer to FIG. 4) is disposed at a portion where the third pressed portion 613 is disposed. In the exemplary embodiment, the second mover 720 having a plate shape is disposed on an extension line of the plate-shaped member 616.

Here, the sheet detecting device 600 according to the exemplary embodiment detects an arrival of the sheet P at the position where the sheet detecting device 600 is disposed. The sheet detecting device 600 also detects a swell of the sheet P that has arrived at the sheet detecting device 600.

Here, detection of a swell of the sheet P will be described.

In the exemplary embodiment, two sensors S, which are the first sensor S1 and the second sensor S2, are used to determine which of the three states of "the sheet P having a small swell", "the sheet P having a large swell", and "the sheet P having an uneven swell", the sheet P is in.

Here, "the sheet P having an uneven swell" is a state where the degree of a swell of the sheet P at the first end in the width direction of the sheet P is different from that of a swell of the sheet P at the second end in the width direction of the sheet P.

Figure 7B:
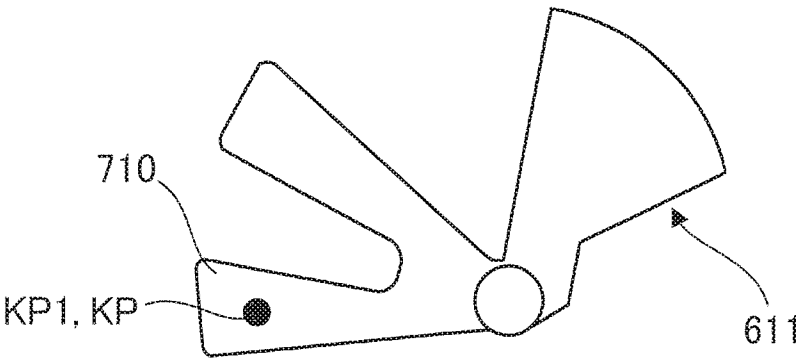
FIGS. 7A and 7B illustrate each portion in the state where "the sheet P has a small swell"
Figure 7A:
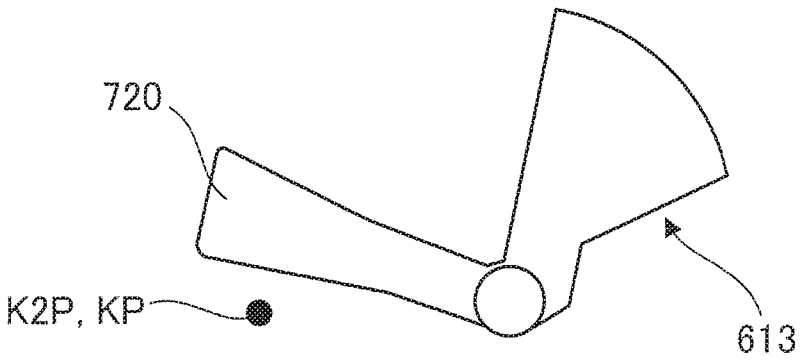

FIGS. 7A and 7B illustrate each portion when "the sheet P has a small swell".

In the drawings subsequent to FIGS. 7A and 7B, the second pressed portion 612 is not illustrated.

FIGS. 7A and 7B illustrate the state of each portion when the degree of a swell at the first end in the width direction of the sheet P is equal to the degree of a swell at the second end, and the degree of the swell is a first degree, which is a small degree.

When the degree of a swell is the first degree, only the first mover 710 arrives at the first detection position KP1 for the first sensor S1, and the second mover 720 does not arrive at the second detection position KP2 for the second sensor S2.

In this case, the controller 30 according to the present exemplary embodiment detects the sheet P having a small swell.

More specifically, in the state illustrated in FIGS. 7A and 7B, the first mover 710 arrives at the first detection position KP1 for the first sensor S1, and the first sensor S1 is turned off, while the second mover 720 does not arrive at the second detection position KP2, and the second sensor S2 is turned on.

More specifically, in the exemplary embodiment, the first mover 710 is located further downstream than the second mover 720 in the mover movement direction 5X, as described above.

In the exemplary embodiment, when the degree of a swell at the first end in the width direction of the sheet P is equal to the degree of a swell at the second end and the degree of this swell is a first degree, which is a small degree, the first mover 710 arrives at the first detection position KP1 and the first sensor S1 is turned off, while the second mover 720 does not arrive at the second detection position KP2 and the second sensor S2 is turned on.

In this case, the controller 30 detects the sheet P having a small swell.

More specifically, in the exemplary embodiment, a determination table illustrated in FIG. 8 (illustrating the determination table) is registered in the storage 404 (refer to FIG. 2), and the controller 30 detects the sheet P having a small swell with reference to this determination table.

More specifically, when the first sensor S1 is turned off and the second sensor S2 is turned on, the state corresponds to the state denoted with a reference sign 8A in FIG. 8, and the controller 30 detects the sheet P having a small swell.

Figure 9B:
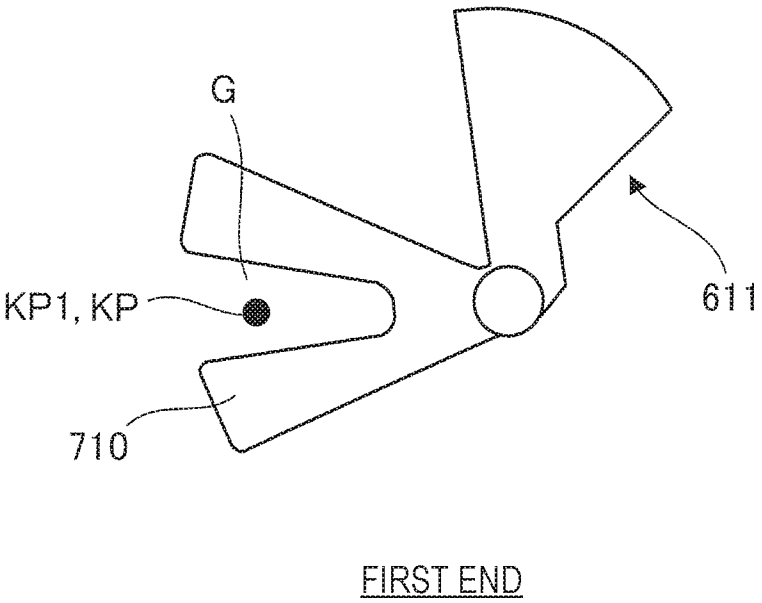
FIGS. 9A and 9B illustrate each portion when "the sheet P has a large swell"
Figure 9A:
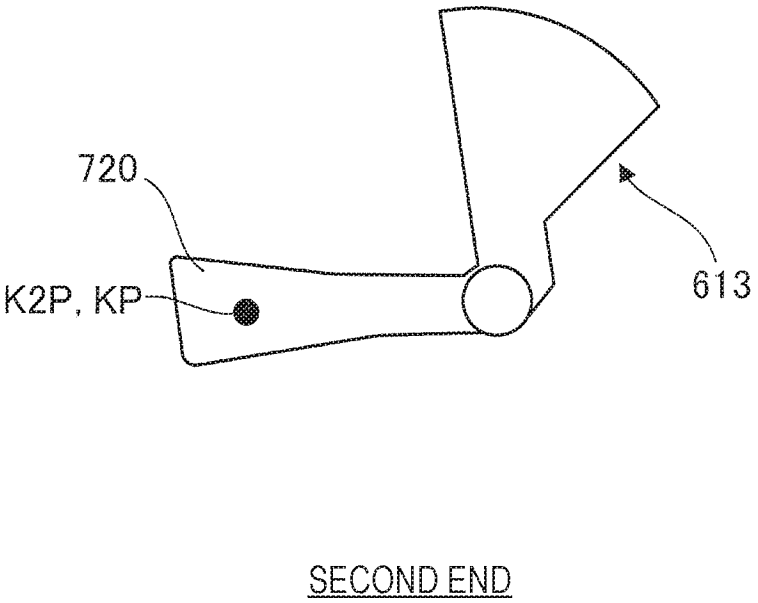

FIGS. 9A and 9B illustrate each portion when "the sheet P has a large swell".

When the sheet P has a large swell, each portion has the state illustrated in FIGS. 9A and 9B.

More specifically, when the sheet P has a large swell and the degree of a swell at the first end in the width direction of the sheet P is equal to the degree of a swell at the second end, each portion has the state illustrated in FIGS. 9A and 9B.

More specifically, when the sheet P has a large swell and the degree of a swell at the first end in the width direction of the sheet P and the degree of a swell at the second end are a second degree, which is larger than the first degree, each portion has the state illustrated in FIGS. 9A and 9B.

When the degree of a swell of the sheet P is the second degree, the first mover 710 passes by the first detection position KP1, whereas the second mover 720 arrives at the second detection position KP2. Here, the controller 30 detects the sheet P having a large swell.

More specifically, when the swell of the sheet P is in the second degree, the first sensor S1 is turned on, and the second sensor S2 is turned off. This state corresponds to the state denoted with the reference sign 8B in FIG. 8, and the controller 30 detects the sheet P having a large swell.

Figure 10B:
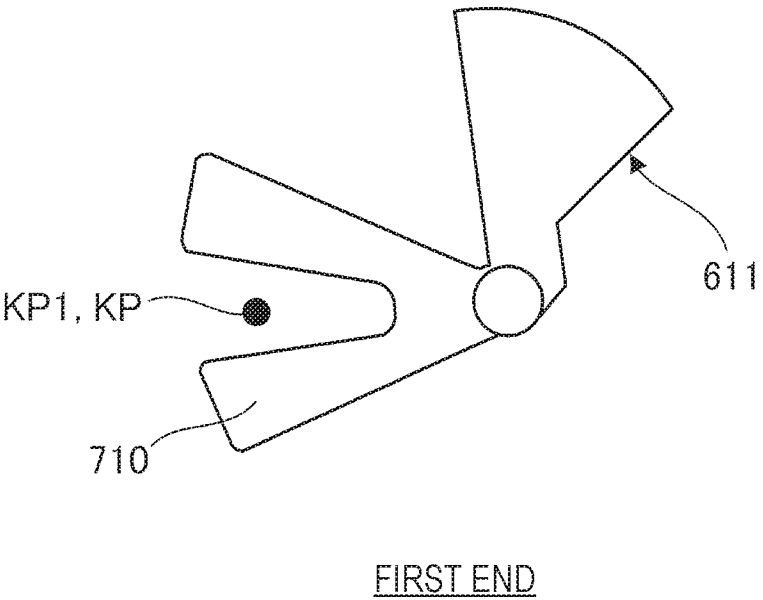
FIGS. 10A and 10B illustrate each portion when the sheet P has an uneven swell.
Figure 10A:
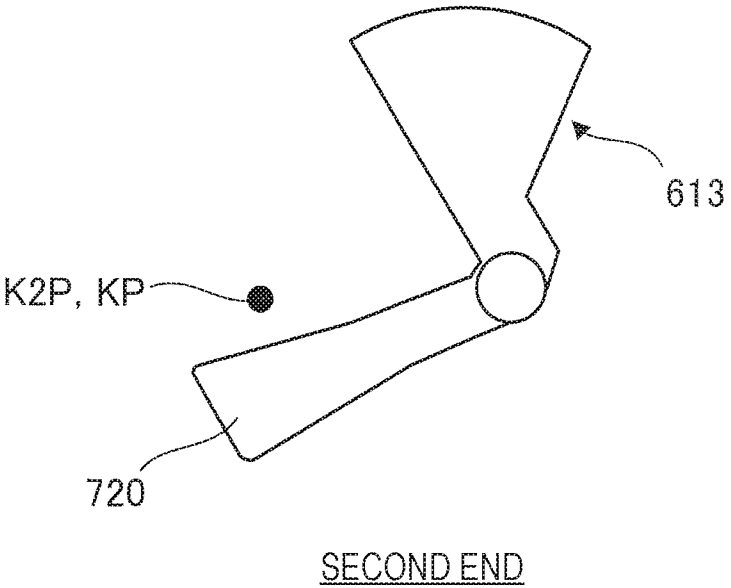

In the exemplary embodiment, when the sheet P has an uneven swell, for example, the degree of a swell at the first end in the width direction of the sheet P is the second degree and the degree of a swell at the second end in the width direction of the sheet P is a third degree, which is larger than the second degree, each portion has the states illustrated in FIGS. 10A and 10B (illustrating the state of each portion when the sheet P has an uneven swell).

Here, the first sensor S1 is turned on, and the second sensor S2 is turned on.

This state corresponds to the state denoted with the reference sign 8D in FIG. 8, and the controller 30 detects the sheet P having an uneven swell.

Figure 11B:
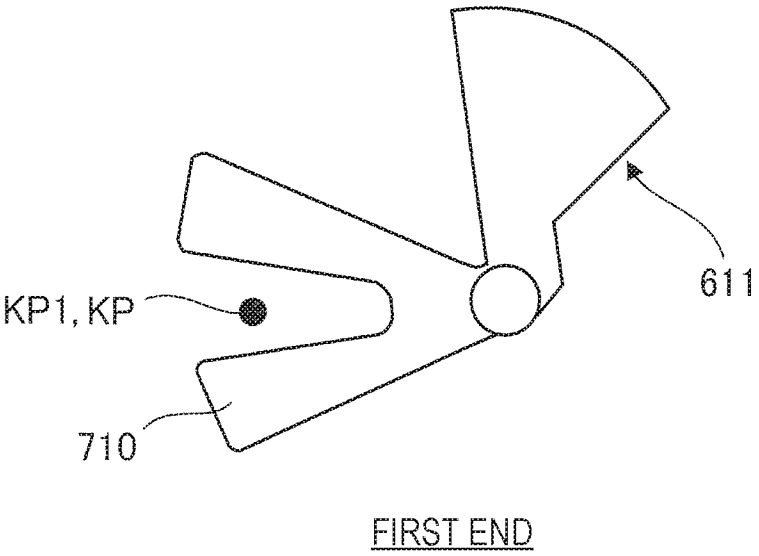
FIGS. 11A and 11B illustrate each portion when the sheet P has an uneven swell.
Figure 11A:
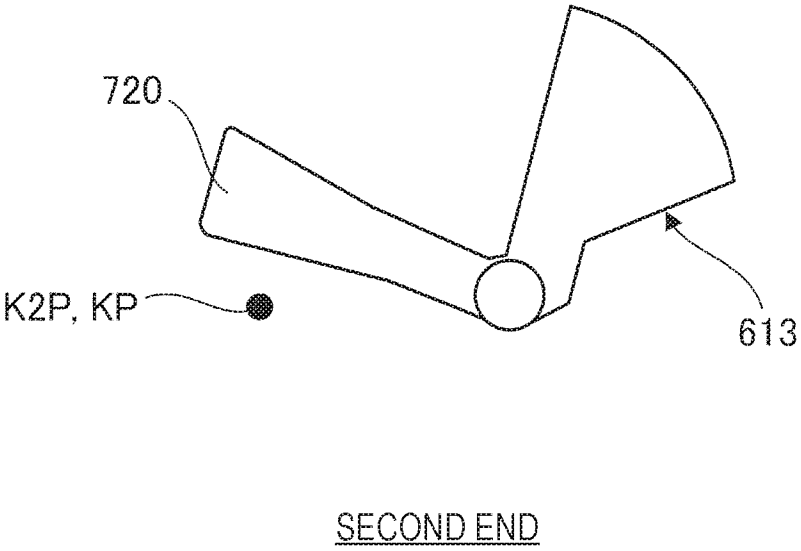

When the sheet P has an uneven swell, for example, the degree of a swell at the first end in the width direction of the sheet P is the second degree and the degree of a swell at the second end in the width direction of the sheet P is the first degree, each portion has the state illustrated in FIGS. 11A and 11B (illustrating the state of each portion when the sheet P has an uneven swell).

Here, the first sensor S1 is turned on, and the second sensor S2 is turned on.

This state corresponds to the state denoted with the reference sign 8D in FIG. 8, and the controller 30 detects the sheet P having an uneven swell.

Figure 12B:
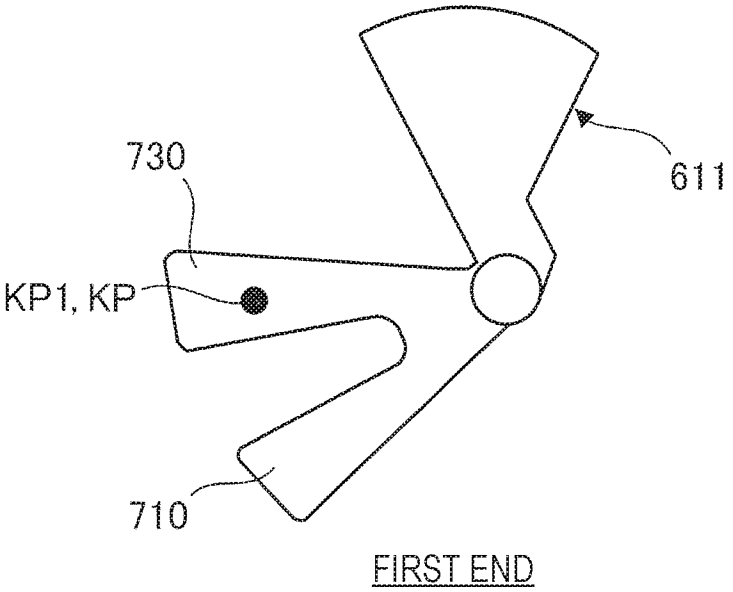
FIGS. 12A and 12B illustrate each portion when the sheet P has an uneven swell.
Figure 12A:
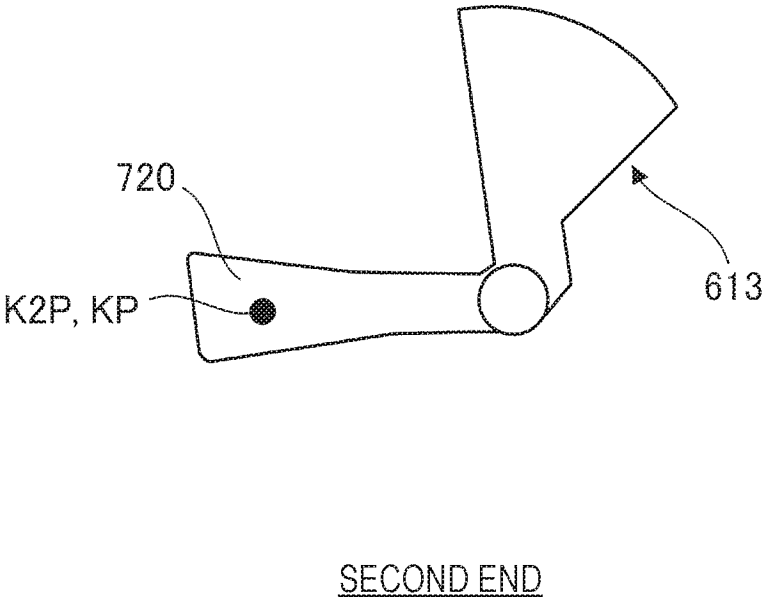

When the sheet P has an uneven swell, for example, the degree of a swell at the second end in the width direction of the sheet P is the second degree and the degree of a swell at the first end in the width direction of the sheet P is the third degree, each portion has the state illustrated in FIGS. 12A and 12B (illustrating the state of each portion when the sheet P has an uneven swell).

In this case, the first sensor S1 is turned off, and the second sensor S2 is turned off. More specifically, in the state illustrated in FIGS. 12A and 12B, the third mover 730 is located at the first detection position KP1, and the first sensor S1 is turned off.

This state corresponds to the state denoted with the reference sign 8C in FIG. 8, and the controller 30 detects the sheet P having an uneven swell.

Figure 13B:
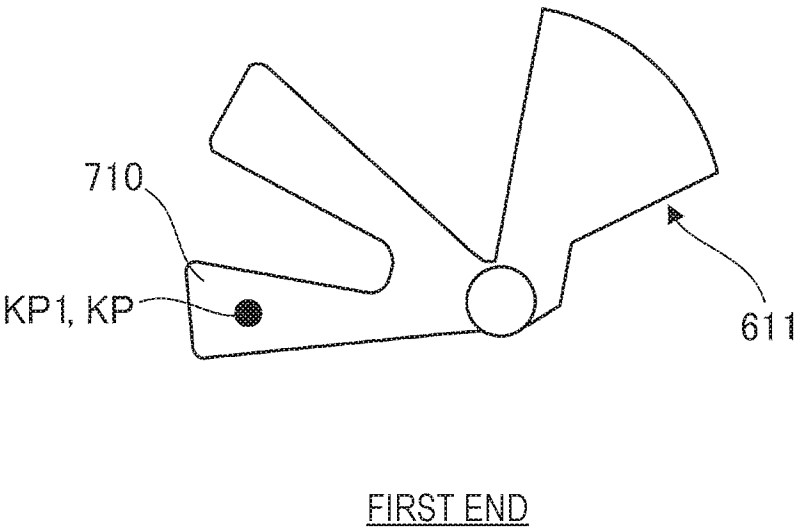
FIGS. 13A and 13B illustrate each portion when the sheet P has an uneven swell.
Figure 13A:
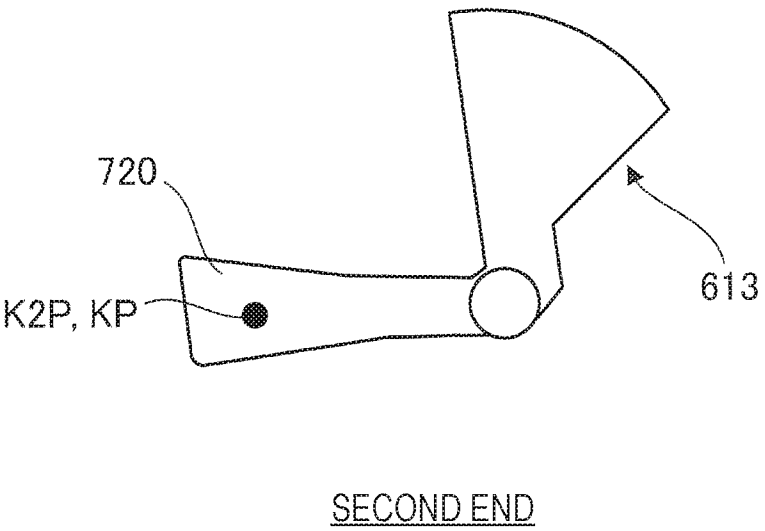

When the sheet P has an uneven swell, for example, the degree of a swell at the second end in the width direction of the sheet P is the second degree, and the degree of a swell at the first end in the width direction of the sheet P is the first degree, each portion has the state illustrated in FIGS. 13A and 13B (illustrating the state of each portion when the sheet P has an uneven swell).

Here, the first sensor S1 is turned off, and the second sensor S2 is turned off.

This state corresponds to the state denoted with the reference sign 8C in FIG. 8, and the controller 30 detects the sheet P having an uneven swell.

In the exemplary embodiment, three states of a swell of the sheet P is detected with two sensors S, as described above.

Figure 14:
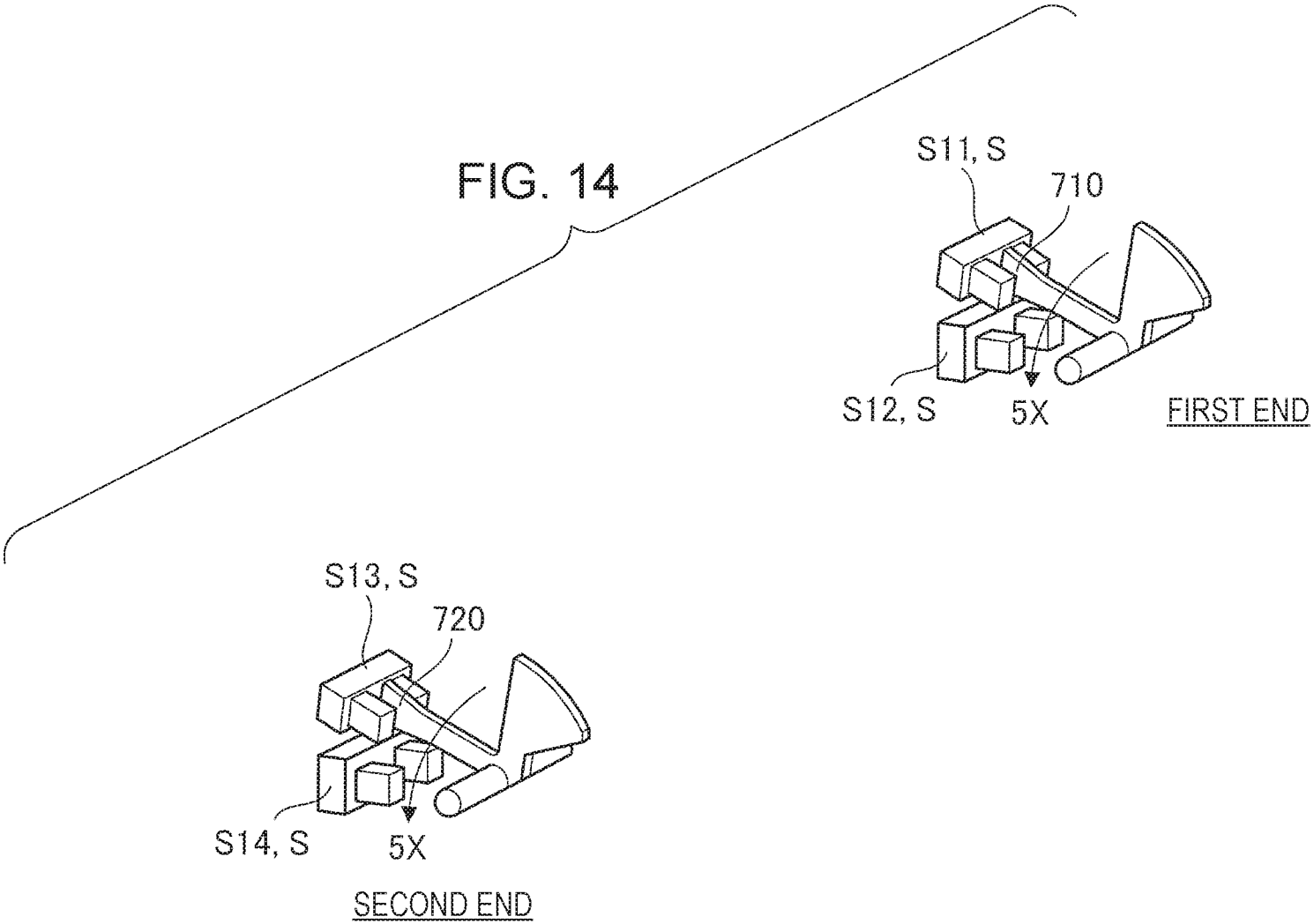
FIG. 14 illustrates a comparative example.

FIG. 14 illustrates a comparative example.

In this example, three states of a swell of the sheet P is detected with four sensors S.

More specifically, this comparative example includes a first sensor S11 and a second sensor S12, which are disposed on the side closer to the first end in the width direction of the sheet P and at different positions in the mover movement direction 5X.

This comparative example also includes a third sensor S13 and a fourth sensor S14, which are disposed on the side closer to the second end in the width direction of the sheet P and at different positions in the mover movement direction 5X.

In this comparative example, three states are detected with these four sensors S.

Specifically, in this comparative example, when, for example, the first sensor S11 detects the first mover 710 and the third sensor S13 detects the second mover 720, it is determined that "the sheet P has a small swell".

In this comparative example, when, for example, the second sensor S12 detects the first mover 710 and the fourth sensor S14 detects the second mover 720, it is determined that "the sheet P has a large swell".

In this comparative example, when, for example, the first sensor S11 detects the first mover 710 and the fourth sensor S14 detects the second mover 720, it is determined that "the sheet P has an uneven swell".

When, for example, the second sensor S12 detects the first mover 710 and the third sensor S13 detects the second mover 720, it is determined that "the sheet P has an uneven swell".

This comparative example is also capable of detecting three states, that is, "the sheet P having a small swell", "the sheet P having a large swell", and "the sheet P having an uneven swell". However, this comparative example involves four sensors S for detection of these three states.

On the other hand, the exemplary embodiment is capable of detecting three states, that is, "the sheet P having a small swell", "the sheet P having a large swell", and "the sheet P having an uneven swell" with two sensors, that is, the first sensor S1 and the second sensor S2.

In the above structure, three states are detected with the first mover 710 and the second mover 720 shifted from each other. Instead, the three states may be detected by shifting the first detection position KP1 and the second detection position KP2 without shifting the first mover 710 and the second mover 720.

More specifically, the three states may be detected by shifting the first detection position KP1 and the second detection position KP2 in the mover movement direction 5X, which is a movement direction in which the first mover 710 to the third mover 730 move.

Figure 15B:
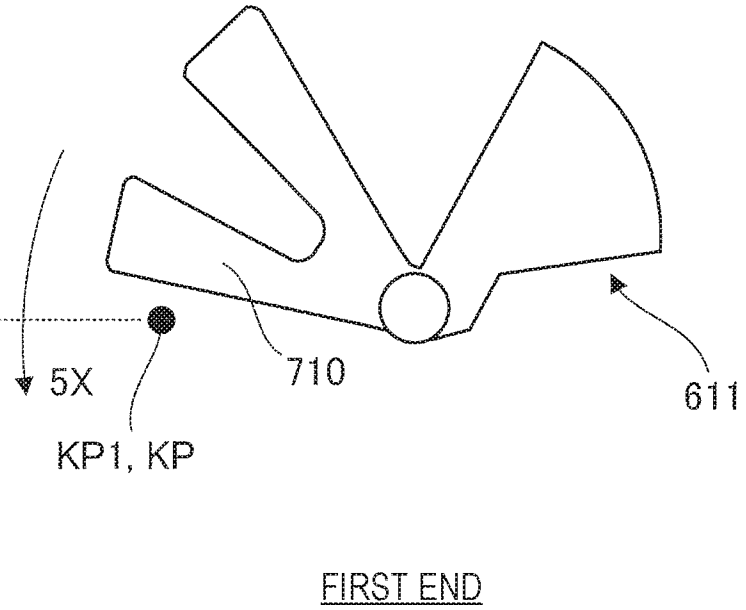
FIGS. 15A and 15B illustrate another arrangement example of a first detection position and a second detection position.
Figure 15A:
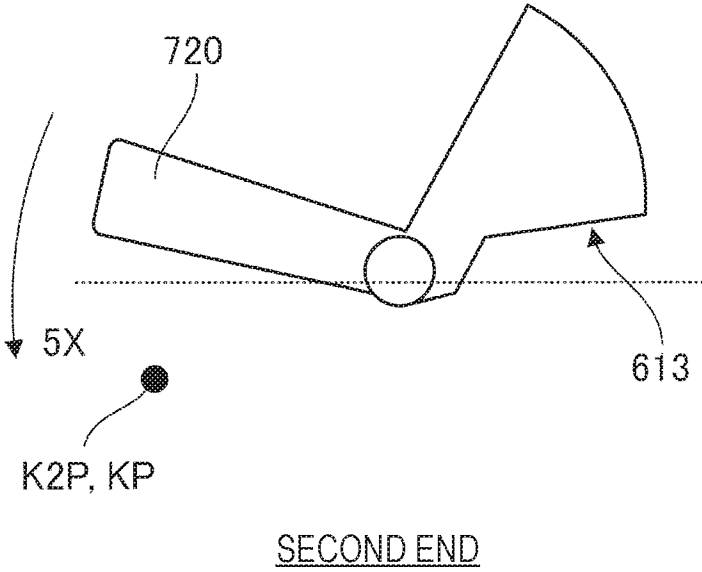

More specifically, for example, three states, that is, "the sheet P having a small swell", "the sheet P having a large swell", and "the sheet P having an uneven swell" may be detected with the structure illustrated in FIGS. 15A and 15B (another arrangement example of the first detection position KP1 and the second detection position KP2).

In the structure example illustrated in FIGS. 15A and 15B, the position of the first mover 710 in the mover movement direction 5X and the position of the second mover 720 in the mover movement direction 5X are aligned.

On the other hand, in this structure example, the second detection position KP2 for the second sensor S2 is located further downstream in the mover movement direction 5X than the first detection position KP1 for the first sensor S1.

In this structure example, the state where "the sheet P has a small swell" is the first state where the first mover 710 arrives at the first detection position KP1 for the first sensor S1. Thus, "the sheet P having a small swell" is detected.

The state where "the sheet P has a large swell" is a second state where the first mover 710 passes by the first detection position KP1 whereas the second mover 720 arrives at the second detection position KP2 for the second sensor S2. Thus, "the sheet P having a large swell" is detected.

The state where, for example, the sheet P has an uneven swell" is the state other than the first state and the second state. In this case, when this another state is detected, "the sheet P having an uneven swell" is detected.

Here, in the exemplary embodiment, when the sheet P is transported to arrive at the sheet detecting device 600, the sheet P comes into contact with any of the first pressed portion 611 to the third pressed portion 613.

Thus, an arrival of the sheet P at the position where the sheet detecting device 600 is installed is detected in the exemplary embodiment.

Here, in the exemplary embodiment, when the sheet detecting device 600 fails to detect the sheet P by predetermined timing, the sheet P is determined to be jammed and, for example, transportation of the sheet P is stopped.

Here, in the exemplary embodiment, when an A4-size or greater sheet P is transported to the sheet detecting device 600, the sheet P comes into contact with the first pressed portion 611 and the third pressed portion 613.

More specifically, in the exemplary embodiment, as described above, the second pressed portion 612 is located further downstream in the pressed-portion movement direction 5A than the first pressed portion 611. Thus, when the A4-size or greater sheet P is transported to the sheet detecting device 600, the sheet P comes into contact with the first pressed portion 611 and the third pressed portion 613.

Thus, in the exemplary embodiment, an arrival of the A4-size or greater sheet P at the position where the sheet detecting device 600 is installed is detected.

In the exemplary embodiment, when the A4-size or greater sheet P is transported, the sheet P comes into contact with the first pressed portion 611 and the third pressed portion 613, and the first mover 710 to the third mover 730 move.

Here, in the exemplary embodiment, as described above, the controller 30 detects the state of a swell of the sheet P.

More specifically, the controller 30 determines which of the states where "the sheet P has a small swell", "the sheet P has a large swell", and "the sheet P has an uneven swell" the transported sheet P is in.

In the exemplary embodiment, the controller 30 adjusts the transport speed of the sheet P at the fixing device 40 in accordance with the detected state of a swell.

For example, when the controller 30 detects "the sheet P having a small swell", the controller 30 reduces the transport speed of the sheet P at the fixing device 40 to increase the swell of the sheet P.

More specifically, when the controller 30 detects "the sheet P having a small swell" and the sheet P is of a predetermined type, the controller 30 reduces the transport speed of the sheet P at the fixing device 40 to increase the swell of the sheet P.

When the transport speed of the sheet P at the fixing device 40 is reduced, the distance by which the sheet P is transported by the fixing device 40 per unit time is reduced. On the other hand, the sheet P is transported at the predetermined speed from upstream of the fixing device 40. More specifically, the sheet P is transported at the same, unchanged speed from upstream of the fixing device 40.

In this case, transportation of the sheet P is slowed at the fixing device 40 to increase the swell of the sheet P.

For example, when the controller 30 detects "the sheet P having a large swell", the controller 30 increases the transport speed of the sheet P at the fixing device 40 to reduce the swell of the sheet P.

More specifically, when the controller 30 detects "the sheet P having a large swell" and the sheet P is of a predetermined type, the controller 30 increases the transport speed of the sheet P at the fixing device 40 to reduce the swell of the sheet P.

For example, when the controller 30 detects "the sheet P having an uneven swell", the controller 30 increases the transport speed of the sheet P at the fixing device 40 to reduce the swell of the sheet P.

In the exemplary embodiment, when an A4-size or smaller sheet P such as a postcard-size sheet is transported, the sheet P comes into contact with only the second pressed portion 612.

More specifically, in the exemplary embodiment, when a sheet P (referred to as a "small-size sheet P", below) smaller than a specific size such as the A4 size is transported, this small-size sheet P comes into contact with only the second pressed portion 612.

As in the above case, an arrival of the small-size sheet P at a portion where the sheet detecting device 600 is installed is detected.

When the small-size sheet P is transported, the small-size sheet P does not come into contact with the first pressed portion 611 and the third pressed portion 613. No detection is performed on the state of a swell of the small-size sheet P.

In the exemplary embodiment, as described above, the second pressed portion 612 is located further downstream in the pressed-portion movement direction 5A than the first pressed portion 611.

Thus, in the exemplary embodiment, when an A4-size or greater sheet P (hereinafter referred to as a "large-size sheet P") is transported, a load exerted on the large-size sheet P is reduced further than in the case where the first pressed portion 611 to the third pressed portion 613 are aligned in the pressed-portion movement direction 5A.

Here, the first pressed portion 611 to the third pressed portion 613 may be aligned. In this case, however, the second pressed portion 612 comes into contact with the large-size sheet P every time when the large-size sheet P is transported, and the load exerted on the large-size sheet P is increased.

On the other hand, when, as in the exemplary embodiment, the second pressed portion 612 is located further downstream in the pressed-portion movement direction 5A than the first pressed portion 611 and the third pressed portion 613, the load exerted on the large-size sheet P is reduced.

More specifically, when, as in the exemplary embodiment, the second pressed portion 612 is located further downstream in the pressed-portion movement direction 5A than the first pressed portion 611 and the third pressed portion 613, the load exerted on the large-size sheet P is reduced while detection of a small-size sheet P is enabled.

In the exemplary embodiment, the case where the large-size sheet P does not come into contact with the second pressed portion 612 is described. However, this does not exclude the structure where the large-size sheet P comes into contact with the second pressed portion 612. The large-size sheet P may come into contact with the second pressed portion 612.

Also in this case, as in the above case, preferably, the second pressed portion 612 is located further downstream in the pressed-portion movement direction 5A than the first pressed portion 611 and the third pressed portion 613, and the contact pressure exerted when the sheet P and the second pressed portion 612 come into contact with each other is smaller than the contact pressure exerted when the sheet P and the first pressed portion 611 and the third pressed portion 613 come into contact with each other.

As above, the exemplary embodiment has described the case where the first mover 710 and the third mover 730 are located closer to the side where the first pressed portion 611 is disposed. Instead, the first mover 710 and the third mover 730 may be located closer to the second pressed portion 612, such as on the extension line of a plate-shaped member 617 (refer to FIG. 4) disposed closer to the second pressed portion 612.

Nevertheless, as in the exemplary embodiment, the structure including the first mover 710 and the third mover 730 disposed closer to the first pressed portion 611 detects a swell more highly accurately, as described above.

When the first mover 710 and the third mover 730 are disposed closer to the second pressed portion 612, the distance between the first pressed portion 611 for swell detection and the first mover 710 and the third mover 730 is increased.

More specifically, when the first mover 710 and the third mover 730 are disposed closer to the second pressed portion 612, a round bar-shaped connector 650 (refer to FIG. 4) is disposed between the first mover 710 and the third mover 730 and the first pressed portion 611.

In this case, due to, for example, a twist of the connector 650, the distance by which the first mover 710 and the third mover 730 move may be smaller than the distance by which the first pressed portion 611 moves.

More specifically, the distance by which the first pressed portion 611 moves may differ from the distance by which the first mover 710 and the third mover 730 move.

In this case, the swell detection accuracy may degrease.

On the other hand, in the structure where the first mover 710 and the third mover 730 are disposed closer to the side where the first pressed portion 611 is disposed, the effect of the twist is reduced, and reduction of the swell detection accuracy is thus prevented.

In a more preferable aspect, as described above, the first mover 710 and the third mover 730 are disposed on the extension line 29 of the plate-shaped member 615 disposed on the first pressed portion 611. In this case, reduction of the swell detection accuracy is further reduced.

The present disclosure is not only applicable to an electrophotographic image forming apparatus, and is also applicable to other image forming apparatuses such as an inkjet or thermal printer.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording-medium transport device, comprising:

a first pressed portion that moves by being pressed by a transported recording medium;

a second pressed portion disposed at a different position from the first pressed portion in a width direction of the transported recording medium, the second pressed portion moving by being pressed by the transported recording medium;

a mover that moves in association with the first pressed portion and the second pressed portion, the mover moving in response to the recording medium being pressed by at least one of the first pressed portion and the second pressed portion, wherein each of the first pressed portion and the second pressed portion is different from the mover; and a sensor that detects movement of the mover.

2. The recording-medium transport device according to claim 1, wherein the first pressed portion and the second pressed portion move in a first direction when pressed by the recording medium, and one of the first pressed portion and the second pressed portion is located downstream in the first direction than the other one of the first pressed portion and the second pressed portion.

3. The recording-medium transport device according to claim 2, wherein, when a recording medium having a specific size is transported and arrives at the first pressed portion, the first pressed portion opposes an end of the recording medium in the width direction, and when the recording medium arrives at the second pressed portion, the second pressed portion opposes a center portion of the recording medium in the width direction, and wherein the second pressed portion is located downstream in the first direction than the first pressed portion.

4. The recording-medium transport device according to claim 1, wherein one of the first pressed portion and the second pressed portion is formed from part of a plate member.

5. The recording-medium transport device according to claim 1, wherein one of the first pressed portion and the second pressed portion is formed from part of a plate member, and the plate member extends in a thickness direction of the transported recording medium, and wherein the mover is disposed on an extension line of the plate member.

6. The recording-medium transport device according to claim 1, wherein the mover is disposed closer to one of the first pressed portion and the second pressed portion.

7. The recording-medium transport device according to claim 6, wherein one of the first pressed portion and the second pressed portion is formed from part of a plate member, and the plate member extends in a thickness direction of the transported recording medium, and wherein the mover is disposed on an extension line of the plate member.

8. The recording-medium transport device according to claim 7, wherein when the recording medium having the specific size is transported and arrives at the plate member, the plate member opposes an end of the recording medium in the width direction, and wherein the mover is disposed on the extension line of the plate member located at the portion opposite to the end.

9. The recording-medium transport device according to claim 1, further comprising:

a third pressed portion disposed at a different position from the first pressed portion and the second pressed portion in the width direction of the transported recording medium, the third pressed portion moving by being pressed by the transported recording medium;

a second mover that moves in association with the third pressed portion; and a second sensor that detects movement of the second mover.

10. The recording-medium transport device according to claim 9, wherein a first mover, which is the mover that moves in association with the first pressed portion and the second pressed portion, and the second mover that moves in association with the third pressed portion are movable in a first direction, and wherein a position of the first mover in the first direction is different from a position of the second mover in the first direction when the first pressed portion, the second pressed portion, and the third pressed portion are not pressed by the recording medium.

11. The recording-medium transport device according to claim 9, wherein a first mover, which is the mover that moves in association with the first pressed portion and the second pressed portion, and the second mover that moves in association with the third pressed portion are movable in a first direction, and a position of a detection position in the first direction at which a first sensor detects the first mover is different from a position of a detection position in the first direction at which the second sensor detects the second mover, the first sensor being the sensor that detects movement of the first mover.

12. An image forming apparatus, comprising:

an image forming member that forms an image on a recording medium; and a recording-medium transport device that transports the recording medium, wherein the recording-medium transport device includes the recording-medium transport device according to claim 1.

13. A recording-medium transport device, comprising:

first pressed means for moving by being pressed by a transported recording medium;

second pressed means for moving by being pressed by the transported recording medium, the second pressed means disposed at a different position from the first pressed means in a width direction of the transported recording medium;

mover means for moving in association with the first pressed means and the second pressed means, the mover means moving in response to the recording medium being pressed by at least one of the first pressed means and the second pressed means wherein each of the first pressed means and the second pressed means is different from the mover means; and sensor means for detecting movement of the mover means.

* * * * *